United States Patent [19]

Das et al.

[11] Patent Number: 4,865,657

[45] Date of Patent: Sep. 12, 1989

[54] HEAT TREATMENT OF RAPIDLY QUENCHED FE-6.5 WT % SI RIBBON

[76] Inventors: Santosh K. Das, 10 Farm Rd., Randolph, N.J. 07869; Chin-Fong Chang, 61 Beechwood Ave., Lake Hiawatha, N.J. 07034; Richard L. Bye, Jr., 2 Edgehill Ave., Morristown, N.J. 07960

[21] Appl. No.: 183,342

[22] Filed: Apr. 12, 1988

Related U.S. Application Data

[63] Continuation of Ser. No. 894,139, Aug. 1, 1986, abandoned.

[51] Int. Cl.[4] ..... H01F 1/04

[52] U.S. Cl. ..... 148/113; 148/122

[58] Field of Search ..... 148/110–113, 148/120–122

[56] References Cited

U.S. PATENT DOCUMENTS 4,257,830 3/1981 Tsuya et al. ..... 148/112
4,265,682 5/1981 Tsuya et al. ..... 148/112

FOREIGN PATENT DOCUMENTS 56-3625 1/1981 Japan ..... 148/112
60-152663 8/1985 Japan ..... 148/121

OTHER PUBLICATIONS

Arai et al., "Grain Growth of Rapid Quenching High Silicon Iron Alloys", IEEE Trans. on Magnetics, vol. MAG 5, Sep. 1984, pp. 1463–1465.

K. I. Arai, H. Tsutsumitake, K. Ohmori. "Grain Growth and Texture Formation by Annealing of Rapidly Quenched High Silicon–Iron Alloy." *Transactions of the Japan Institute of Metals,* vol. 25, No. 12 (1984), pp. 855–862.

C. F. Chang, R. L. Bye, V. Laxmanan, S. K. Das. "Texture and Magnetic Properties of Rapidly Quenched Fe–6.5 wt. % Si Ribbon." *Transactions on Magnetics,* vol. MAG–20, No. 4, Jul. 1984, pp. 553–558.

"Rapidly Solidified Materials,"0 ed. by P. W. Lee and R. S. Carbonara, pp. 273–281. *American Society for Metals,* Ohio (1986).

T. Miyazaki, T. Kozakai, T. Tsuzuki. "Phase Demopositions of Fe–Si–Al Ordered Alloys." *Journal of Materials Science 21,* (1986), pp. 2557–2564.

K. Narita, M. Enokizono, "Effect of Ordering on Magnetic Properties of 6.5–Percent Silicon–Iron Alloy." *Transactions on Magnetics,* vol. MAG–15, No. 1, Jan. 1979, pp. 911–915.

M. J. Tenwick, H. A. Davies, "The Structure and Properties of Rapidly Solidified Fe–3 to 9.3 wt. % Si Alloys." *International Journal of Rapid Solidification,* 1984–85, vol. 1, pp. 143–155.

*Primary Examiner*—John P. Sheehan

[57] ABSTRACT

A rapidly quenched Fe-Si alloy containing 6 to 7 wt % Si is heat treated to promote and control an order-disorder reaction, thereby improving its ac core loss and exciting power at induction levels above B=1.2 T. The alloy has a substantially <100> texture, a grain size of about 1 to 2 mm, a B2 domain size of 100 to 850 nm, a DO3 domain size of about 5 to 25 nm, an ac core loss of about 1.2 to 1.6 W/kg and an exciting power of about 15 to 46 VA/kg, the core loss and exciting power being measured at an induction level of B=1.4 T and a frequency of f=60 Hz.

5 Claims, 3 Drawing Sheets

HEAT TREATMENT OF RAPIDLY QUENCHED FE-6.5 WT % SI RIBBON

This application is a continuation of application Ser. No. 894,139 filed Aug. 1, 1986.

FIELD OF THE INVENTION

This invention relates to a heat-treatment of rapidly quenched Fe-6.5 wt % Si that, by controlling an order-disorder reaction, results in improved magnetic properties at high induction levels.

DESCRIPTION OF THE PRIOR ART

Fe-6.5 wt % Si alloy has extremely desirable ferromagnetic properties but has poor mechanical properties. It ordinarily has poor ductility and is not easily formed into thin ribbons or sheets that can be stamped or wound into selected shapes. A copending application (Ser. #545,569, filed Oct. 26, 1983, now U.S. Pat. No. 4,649,983 invention (Invention record P.D. 81-2033, Ser. #545,569 now U.S. Pat. No. 4,649,983) teaches a method of processing Fe-Si alloys containing 6 to 7 wt % Si to produce thin, ductile ribbon with improved magnetic properties. To produce the ribbon, a stream of molten alloy is ejected through a nozzle and rapidly quenches on the circumferential surface of a rapidly rotating disk, thereby forming a continuous sheet of alloy. The as-cast ribbon is then vacuum annealed at temperatures ranging from 1000° C. to 1200° C. to obtain a columnar grain structure of a controlled size with a <100> fiber texture. This process results in a material with a power loss of 0.46 W/kg and an exciting power of 0.62 VA/kg at B=1.0 T and f=60 Hz, these properties being isotropic in the plane of the ribbon. No teaching is contained therein regarding induction levels above 1.0 T.

The order-disorder phenomenon and the resulting phase diagram of high silicon-iron alloys have been reported in the literature. It is known that the orderdisorder reaction affects the magnetic properties of materials ranging from those that are structure sensitive to those that are intrinsic. It has been reported that in Fe-6.5 wt % Si, magnetostriction decreases with the growth of the DO3 domains and magnetic anisotropy decreases with the growth of the B2 domains. Through appropriate heat treatments to control the order-disorder reaction, material was produced with a maximum permeability ($\mu_m$) of 52,000, and a coercive force ($H_c$) of 0.088 Oe at a maximum induction of 1.0 T. These properties are not useful for electromagnetic applications such as transformers, generators and motors, however. In these devices, properties such as low ac core loss and exciting power at high induction levels (greater than 1.0 T) are essential. No attempt has been made to improve the magnetic properties of rapidly quenched Fe-6.5 wt % Si at high induction levels by controlling the order-disorder reaction.

SUMMARY OF THE INVENTION

The invention provides a method for heat-treating rapidly quenched Fe-Si alloys containing 6 to 7 wt % Si which controls the order-disorder reaction and results in improved magnetic properties such as low ac core loss and low exciting power at high induction levels. Generally stated, the method involves an annealing comprising the steps of: (i) annealing the ribbon to obtain a grain size of about 1–2 mm and a substantially <100> fiber texture wherein the intensity of grains having their <100> crystal direction oriented in a direction substantially normal to the plane of the ribbon is at least 2 times random; and (ii), annealing the ribbon to obtain therein a B2 structure ordered domain size of 100–850 nm, and a DO3 structure ordered domain size of 5–25 nm.

In addition, the invention provides an improved crystalline ribbon consisting essentially of an Fe-Si metal alloy containing 6 to 7 weight percent Si. The ribbon is ductile enough so that it can be readily stamped, wound or otherwise formed into desired shapes. The ribbon has substantially isotropic ferromagnetic properties within the plane thereof and a substantially <100> texture with a texture intensity at least 2 times random. Advantageously, such ribbon has low ac core loss (about 1.2 to 1.6 w/kg at an induction level of 1.4 T and a frequency of 60 Hz) and low exciting power (about 15 to 46 VA/kg) at an induction level of 1.4 T and a frequency of 60 Hz). These improved magnetic properties make the ribbon especially well suited for use in rotors and stators of electromagnetic devices such as motors, generators and the like, which operate at induction levels higher than 1.0 T.

DETAILED DESCRIPTION OF THE INVENTION AND THE PREFERRED EMBODIMENTS

Figure 1A:
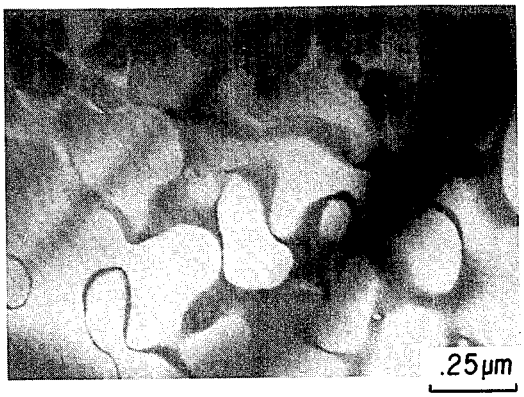
FIG. 1 shows dark field transmission electron micrographs of B2 (1*a*) and DO3 (1*b*) ordered domain structures using superlattice reflections corresponding to the D2 and DO3 structures in selected area diffraction in a ribbon annealed at 1100° C. for 1 hour in vacuum, and annealed at 825° C. for 1 hour in hydrogen atmosphere.

For purposes of the present invention and as used in the specification and claims, a ribbon is a slender body whose transverse dimensions are much less than its length. Such ribbon may comprise the form of a body such as ribbon, strip, or sheet, that is narrow or wide and of regular or irregular cross-section. Also for the purposes of the present invention, a ribbon is considered to be ductile if it can be bent around a radius of 10 times its thickness without fracture.

It is well known that single crystals of iron have a cubic crystalline structure and are most easily magnetized in the <100>, less easily magnetized in the <110> direction, at least easily magnetized in the <111> direction. These directions are expressed in standard crystallographic rotation. This magnetic anistropy has a strong effect on static hysteresis losses during alternating magnetization. In cores for rotating machines the magnetic field is in the plane of the sheet, but the angle between the field and the longitudinal direction of the sheet varies as the core rotates. It is therefore desirable to have a material with a texture such that the "hard" (most difficult to magnetize) <111> direction is not in the plane of the sheet. A <100> "fiber" texture (i.e., a texture in which all grains have a <100> direction normal to the sheet surface and in all possible rotational positions about this normal) is most desirable in ferromagnetic materials in rotating equipment because the sheet then has isotropic ferromagnetic properties in its own plane. A material is considered to have substantially isotropic ferromagnetic properties when its ferromagnetic properties, as determined by the B-H curve thereof, do not vary by more than 20% when measured in any direction within the plane of the ribbon.

The term, texture, as used in the specification and claims hereof, means the predominate orientation of the crystal grains within the metal when compared to a reference sample having randomly oriented grain crystals. Texture can be determined by conventional techniques, such as X-ray diffraction and electron diffraction analysis.

The present invention provides a method of processing as-cast ribbons of Fe-Si alloys containing 6 to 7 wt % Si to obtain optimum B2 and DO3 domain structures. Ribbon processed by the method of this invention is ductile and has improved magnetic properties such as power loss and exciting power at high induction levels. Generally stated, the ribbon is rapidly solidified and then processed by a two-step annealing process comprising the steps of: (i) annealing in vacuum in the temperature range of 1000° C. to 1200° C. for 1 to 4 hours to develop a grain size of about 1 to 2 mm and a <100> texture; and (ii), annealing at a temperature in the range of 500° C. to 900° C. for 1 hour to 4 hours and then cooling at a rate sufficient to preserve the structure (approximately 25° C./min). Such cooling rates are readily achieved by furnace cooling in a hydrogen atmosphere.

In rapidly solidified Fe-Si alloys containing 6 to 7 wt % Si that have been subjected to the first step anneal only, the B2 domain size is approximately 160 nm and there is no evidence of DO3 domains. Ac core losses and exciting power in these materials, while attractive at induction levels below about 1.0 T, increase rapidly at higher induction levels. After the second annealing step of this invention, both B2 and DO3 domains are present and ac core losses and exciting power are substantially improved at induction levels above approximately 1.2 T.

Figure 1C:
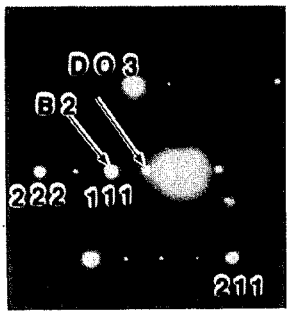
Figure 1B:
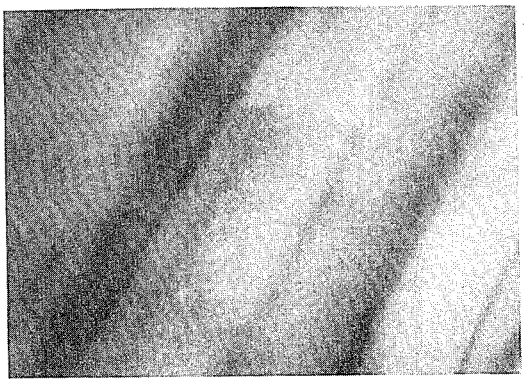

A typical example of the B2 and DO3 domain structure in a Fe-6.5 wt % Si alloy subjected to the heat treatment of this invention is shown in FIG. 1. The domain size is strongly dependent on annealing temperature and only weakly dependent on annealing time. Annealing at temperatures in the lower range of this invention (500° C. to 700° C.) results in a large domain size in the ribbon. A smaller domain size can be achieved by annealing at the higher temperatures of this invention (700° C. to 900° C.). In general, higher second step annealing temperatures and longer annealing times result in smaller B2 and DO3 domain sizes and in lower ac core losses and exciting power at high induction levels. Preferably, the second annealing step is carried out at a temperature between about 790° C. and 860° C. Fe-Si ribbon annealed by this preferred procedure has a B2 domain size of about 100–250 nm, a DO3 domain size of about 5 to 10 nm, an ac core loss of about 1.2 to 1.5 w/kg and an exciting power of about 15 to 26 VA/kg, the ac core loss and exciting power being measured at an induction level of 1.4 T and a frequency of 60 Hz.

The retained ductility and improved magnetic properties of rapidly solidified Fe-Si alloys containing 6 to 7 wt % Si results from the refinement of the ordered domain size thereof. Advantageously, such alloys, when subjected to the two step annealing process of this invention, are rendered especially suitable for use in rotating electromagnetic devices that operate at induction levels above about 1.2 T.

The following examples are presented in order to provide a more complete understanding of the invention. The specific techniques, conditions, materials and reported data set forth to illustrate the invention are exemplary and should not be construed as limiting the scope of the invention.

EXAMPLE 1

Figure 2:
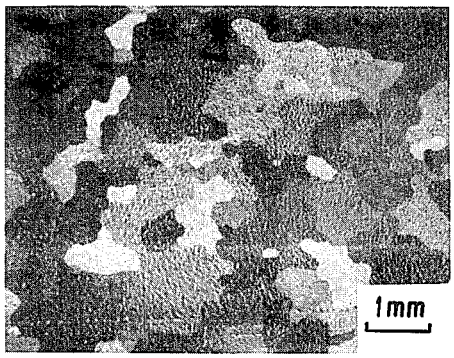
FIG. 2 shows representative micrographs of the grain size and grain morphology of a Fe-6.5 wt % Si ribbon annealed at 1100° C. for 1 hour.
Figure 3:
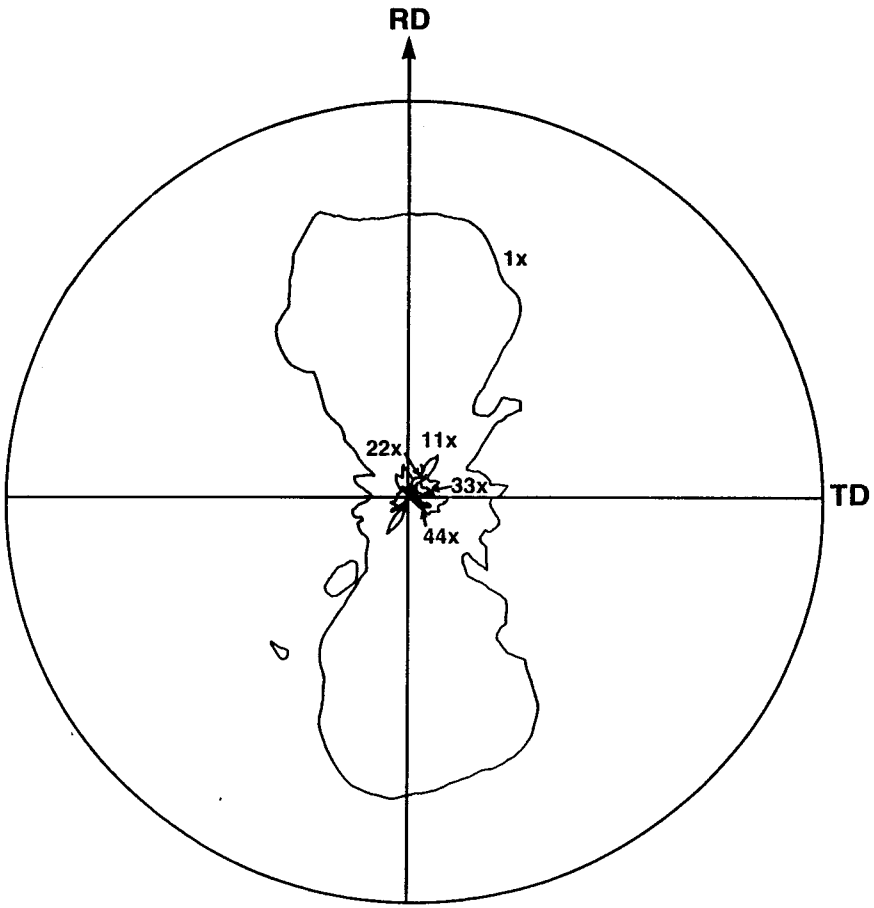
FIG. 3 shows a (200) pole figure of a Fe-6.5 wt % Si ribbon annealed at 1100° C. for 1 hour.

A strip of Fe-6.5 wt % Si alloy was cast using the planar flow casting process described in U.S. Pat. No. 4,331,739 which description is incorporated herein by reference thereto. The as-cast strip had a 100% columnar grain structure with an average grain size of $2.3\times10^{-5}$m, and there were substantially no second phase particles at the grain boundaries. The strip had a near random texture. The material was annealed at 1100° C. for 1 hour in vacuum to obtain the desired <100> texture and optimum grain size. FIG. 2 shows representative micrographs of the grain size and grain morphology in a ribbon annealed at 1100° C. for 1 hour. This annealed ribbon exhibits a strong <100> texture with intensity as high as 44 times random, as shown in FIG. 3.

The domain structure was observed in a Transmission Electron Microscope (TEM) dark field of the superlattice reflections corresponding to the B2 and DO3 structures. The size of B2 domains in the ribbon annealed at 1100° C. for 1 hour is about 160 nm. No evidence of DO3 domains was found in this ribbon.

The magnetic properties (ac core loss and exciting power) of this annealed ribbon are shown in Table 1. These measurements were made by winding the samples, after heat treatment, with 100 turn primary and secondary windings. Core loss measurements were made with a Dranetz 3100 sampling network analyzer. Primary current was determined from the voltage across a 0.1 ohm noninductive resistor in the primary circuit. Resistive losses in the primary circuit were excluded by measuring the induced secondary voltage. The network analyzer sampled these voltage waveforms and calculated the total loss. Exciting power was calculated from rms voltmeter measurements on the same voltage waveforms. A Hewlett Packard 9836 computer was utilized to control the network analyzer and frequency generator as well as to log data from them and from rms and average responding voltmeters via an IEEE 488 bus. A computer program allowed the induction, as calculated from the average responding voltmeter, to be automatically set at preselected values and then all readings logged. The computer calculated values for core loss and exciting power per kilogram. Voltage feedback from the secondary windings was necessary to maintain sinusoidal flux excitation due to the large exciting currents at high induction levels. Air-core flux compensators were also used due to these high exciting currents.

TABLE 1 ac core loss and exciting power of rapidly solidified Fe—6.5 wt % Si ribbon annealed at 1100° C. for 1 hour, values measured at f = 60 Hz.

| Induction Level $B_{Max}$ (T) | Core Loss $W_t$ (W/kg) | Exciting Power $P_z$ (VA/kg) |
|---|---|---|
| 0.6 | 0.29 | 0.50 |
| 0.7 | 0.37 | 0.64 |
| 0.8 | 0.46 | 0.93 |
| 0.9 | 0.57 | 0.94 |
| 1.0 | 0.70 | 1.22 |
| 1.1 | 0.85 | 1.64 |
| 1.2 | 1.06 | 4.24 |
| 1.3 | 1.30 | 16.94 |
| 1.4 | 1.57 | 55.10 |

EXAMPLES 2–10

Samples of materials that had been cast and annealed as in Example 1 were given an additional annealing treatment at temperatures ranging from 500° C. to 900° C. for times ranging from 1 hour to 4 hours in a hydrogen atmosphere. After annealing, the furnace power was turned off and the sample allowed to cool to room temperature. Samples were prepared for microstructural analysis by TEM and for magnetic property measurement as described under Example 1. The following examples illustrate the effect of heat treatment on the domain size and magnetic properties of Fe-6.5 wt % Si ribbon.

The B2 and DO3 domain size, as determined from the TEM analysis, is listed in Table 2 for the different annealing temperatures and times.

TABLE 2

Effect of heat treatment on B2 and DO3 domain size of Fe—6.5 wt % Si after annealing at 1100° C. for 1 hour.

| Example | Annealing Temperature (°C.) | Annealing Time (hours) | B2 domain Size (nm) | DO3 domain Size (nm) |
|---|---|---|---|---|
| 2 | 500 | 1 | 840 | 21 |
| 3 | 600 | 1 | 550 | 20 |
| 4 | 700 | 1 | 480 | 14 |
| 5 | 800 | 1 | 110 | 7 |
| 6 | 800 | 2 | 210 | 7 |
| 7 | 800 | 4 | 230 | 7 |
| 8 | 850 | 1 | 220 | 7 |
| 9 | 850 | 2 | 210 | 7 |
| 10 | 850 | 4 | 190 | 7 |

Examples 2–10 illustrate that the order-disorder reaction in Fe-6.5 wt % Si, as reflected by the change of B2 and DO3 domain size, is strongly affected by the secondary annealing temperature, and relatively independent of annealing time.

The ac core loss and exciting power at various induction levels for these examples, measured at 60 Hz, is listed in Tables 3–8. No data is presented for Examples 7 to 8 due to unavailability of material from which to construct test specimens.

TABLE 3

Effect of heat treatment on ac core loss and exciting power of Fe—6.5 wt % Si after annealing at 1100° C. for 1 hour, measured at an induction level B = 0.6 T, frequency f = 60 Hz.

| Example | Annealing Temperature (°C.) | Annealing Time (hours) | Core Loss (W/kg) | Exciting Power (VA/kg) |
|---|---|---|---|---|
| 2 | 500 | 1 | 0.34 | 0.52 |

TABLE 3-continued

Effect of heat treatment on ac core loss and exciting power of Fe—6.5 wt % Si after annealing at 1100° C. for 1 hour, measured at an induction level B = 0.6 T, frequency f = 60 Hz.

| Example | Annealing Temperature (°C.) | Annealing Time (hours) | Core Loss (W/kg) | Exciting Power (VA/kg) |
|---|---|---|---|---|
| 3 | 600 | 1 | 0.30 | 0.50 |
| 4 | 700 | 1 | 0.31 | 0.49 |
| 5 | 800 | 1 | 0.32 | 0.53 |
| 6 | 800 | 2 | 0.27 | 0.48 |
| 9 | 850 | 2 | 0.22 | 0.47 |
| 10 | 850 | 4 | 0.28 | 0.49 |

TABLE 4

Effect of heat treatment on ac core loss and exciting power of Fe—6.5 wt % Si after annealing at 1100° C. for 1 hour, measured at an induction level B = 0.8 T, frequency f = 60 Hz.

| Example | Annealing Temperature (°C.) | Annealing Time (Hours) | Core Loss (W/kg) | Exciting Power (VA/kg) |
|---|---|---|---|---|
| 2 | 500 | 1 | 0.49 | 0.66 |
| 3 | 600 | 1 | 0.44 | 0.69 |
| 4 | 700 | 1 | 0.44 | 0.64 |
| 5 | 800 | 1 | 0.42 | 0.70 |
| 6 | 800 | 2 | 0.38 | 0.68 |
| 9 | 850 | 2 | 0.40 | 0.72 |
| 10 | 850 | 4 | 0.42 | 0.89 |

TABLE 5

Effect of heat treatment on ac core loss and exciting power of Fe—6.5 wt % Si after annealing at 1100° C. for 1 hour, measured at an induction level B = 1.0 T, frequency f = 60 Hz.

| Example | Annealing Temperature (°C.) | Annealing Time (Hours) | Core Loss (W/kg) | Exciting Power (VA/kg) |
|---|---|---|---|---|
| 2 | 500 | 1 | 0.69 | 1.11 |
| 3 | 600 | 1 | 0.70 | 1.18 |
| 4 | 700 | 1 | 0.63 | 1.13 |
| 5 | 800 | 1 | 0.60 | 1.14 |
| 6 | 800 | 2 | 0.56 | 1.04 |
| 9 | 850 | 2 | 0.62 | 1.05 |
| 10 | 850 | 4 | 0.60 | 1.10 |

TABLE 6

Effect of heat treatment on AC core loss and exciting power of Fe—6.5 wt % Si after annealing at 1100° C. for 1 hour, measured at an induction level B = 1.2 T, frequency f = 60 Hz.

| Example | Annealing Temperature (°C.) | Annealing Time (Hours) | Core Loss (W/kg) | Exciting Power (VA/kg) |
|---|---|---|---|---|
| 2 | 500 | 1 | 1.04 | 3.16 |
| 3 | 600 | 1 | 1.05 | 3.22 |
| 4 | 700 | 1 | 0.94 | 2.76 |
| 5 | 800 | 1 | 0.98 | 2.90 |
| 6 | 800 | 2 | 0.87 | 2.04 |
| 9 | 850 | 2 | 0.90 | 1.69 |
| 10 | 850 | 4 | 0.92 | 2.67 |

TABLE 7

Effect of heat treatment on ac core loss and exciting power of Fe—6.5 wt % Si after annealing at 1100° C. for 1 hour, measured at an induction level B = 1.3 T, frequency f = 60 Hz.

| Example | Annealing Temperature (°C.) | Annealing Time (Hours) | Core Loss (W/kg) | Exciting Power (VA/kg) |
|---|---|---|---|---|
| 2 | 500 | 1 | 1.29 | 11.76 |
| 3 | 600 | 1 | 1.28 | 12.05 |
| 4 | 700 | 1 | 1.17 | 10.08 |
| 5 | 800 | 1 | 1.21 | 11.09 |
| 6 | 800 | 2 | 1.06 | 6.16 |
| 9 | 850 | 2 | 1.06 | 3.42 |
| 10 | 850 | 4 | 1.15 | 12.26 |

TABLE 8

Effect of heat treatment on ac core loss and exciting power of Fe—6.5 wt % Si after annealing at 1100° C. for 1 hour, measured at an induction level B = 1.4 T, frequency f = 60 Hz.

| Example | Annealing Temperature (°C.) | Annealing Time (Hours) | Core Loss (W/kg) | Exciting Power (VA/kg) |
|---|---|---|---|---|
| 2 | 500 | 1 | 1.60 | 42.92 |
| 3 | 600 | 1 | 1.63 | 41.89 |
| 4 | 700 | 1 | 1.41 | 39.86 |
| 5 | 800 | 1 | 1.50 | 45.82 |
| 6 | 800 | 2 | 1.32 | 25.54 |
| 9 | 850 | 2 | 1.26 | 15.36 |
| 10 | 850 | 4 | 1.40 | 38.72 |

The above examples clearly illustrate that rapidly solidified Fe-Si alloys containing 6 to 7 wt % Si and preferably 6.5 wt % Si have improved ac core loss and exciting power at high induction levels when processed by the method of this invention as compared to those having had a single-step anneal only. The improvement in core loss and exciting power is due to the refining of the domain structure as indicated in Table 2. Domain size refinement and, consequently, magnetic properties are particularly enhanced when the second anneal step of this invention is performed at temperatures within the preferred range, 800° C. to 900° C.

Having thus described the invention in rather full detail, it will be understood that such detail need not be strictly adhered to but that various changes and modifications may suggest themselves to one skilled in the art, all falling within the scope of the invention as defined by the subjoined claims.

We claim:

1. A method of heat treatment for Fe-Si alloys consisting of Fe and 6 to 7 wt % Si when rapidly quenched from a melt, which method promotes an order-disorder reaction, thereby improving the magnetic properties at high induction levels, comprising the steps of:

vacuum annealing at a temperature between 1000° C. and 1200° C. for 1 to 4 hours to develop a grain size in the range of 1–2 nm, and a strong <100> texture with intensity at least 2 times that of a reference sample having a randomly oriented grain structure; and annealing at a temperature between 790° C. and 860° C. for 1 to 4 hours and cooling at a rate sufficient to form therein an annealed domain structure of 100–250 nm B2 domains and 5 to 10 nm DO3 domains.

2. A method of heat treatment as recited in claim 1, wherein said vacuum annealing step is performed at a temperature between about 1075° C. and 1125° C.

3. A method of heat treatment as recited in claim 1, wherein said second annealing step is performed in a hydrogen atmosphere.

4. A method of heat treatment as recited in claim 1, wherein said cooling after said second annealing step is performed in a hydrogen atmosphere.

5. A method of heat treatment as recited in claim 1, wherein said cooling after said second annealing step is performed at a rate of between 15° and 35° C. per minute.

* * * * *